US005972851A

United States Patent [19]

Srinivasan et al.

[11] Patent Number: 5,972,851

[45] Date of Patent: Oct. 26, 1999

[54] AUTOMATIC TRANSMISSION FLUIDS HAVING ENHANCED PERFORMANCE CAPABILITIES

[75] Inventors: Sanjay Srinivasan, Midlothian; David Warren Smith, Richmond; John P. Sunne, Midlothian, all of Va.

[73] Assignee: Ethyl Corporation, Richmond, Va.

[21] Appl. No.: 08/979,743

[22] Filed: Nov. 26, 1997

[51] Int. Cl.[6] ..... C10M 137/00; C10M 153/00

[52] U.S. Cl. ..... 508/188; 508/228; 508/294; 508/428; 252/78.5

[58] Field of Search ..... 508/188; 252/78.5

[56] References Cited

U.S. PATENT DOCUMENTS

| | | | |
|---|---|---|---|
| 4,857,214 | 8/1989 | Papay et al. | 252/32.5 |
| 5,078,893 | 1/1992 | Ryer et al. | 252/49.6 |
| 5,198,133 | 3/1993 | Papay | 252/49.9 |
| 5,344,579 | 9/1994 | Ohtani et al. | 508/284 |
| 5,372,735 | 12/1994 | Ohtani et al. | 508/558 |
| 5,441,656 | 8/1995 | Ohtani et al. | 508/558 |
| 5,505,868 | 4/1996 | Ryan et al. | 252/49.8 |
| 5,578,236 | 11/1996 | Srinivasan et al. | 508/188 |
| 5,641,732 | 6/1997 | Bloch et al. | 508/232 |
| 5,641,733 | 6/1997 | Bloch et al. | 508/232 |
| 5,750,476 | 5/1998 | Nibert et al. | 508/291 |

FOREIGN PATENT DOCUMENTS

| | | |
|---|---|---|
| 0 622 444A1 | 11/1994 | European Pat. Off. . |
| 0 747 464A1 | 12/1996 | European Pat. Off. . |

*Primary Examiner*—Ellen M. McAvoy
*Attorney, Agent, or Firm*—Dennis H. Rainear; Thomas Hamilton

[57] ABSTRACT

Automatic transmission fluids are described which contain a dispersant having a nitrogen to phosphorus mass ratio between about 3:1 and about 10:1, and at least one friction modifier. The use of dispersants having a nitrogen to phosphorus mass ratio between about 3:1 and about 10:1 provides automatic transmission fluids which exhibit good anti-shudder properties as well as a higher mid-point torque, a higher static torque in shifting clutch applications and better frictional durability as compared to similar automatic transmission fluids which contain dispersants having a nitrogen to phosphorus mass ratio of less than 3:1.

24 Claims, 8 Drawing Sheets

AUTOMATIC TRANSMISSION FLUIDS HAVING ENHANCED PERFORMANCE CAPABILITIES

TECHNICAL FIELD

This invention relates to oil-based automatic transmission fluid compositions having enhanced performance capabilities, specifically including anti-shudder performance.

BACKGROUND

There is worldwide activity by the automobile manufacturers to develop automatic transmissions incorporating various electronically controlled converter clutch (ECCC) designs. These developments are being driven by the anticipated increase in Corporate Average Fuel Economy (CAFE) requirements in the U.S.A. The ECCC design allows increases in fuel economy to be gained with minimal mechanical modifications to the transmission.

The advent of ECCC transmissions as well as vehicles equipped with a continuously variable transmission (CVT) and advances in aerodynamic body design resulting from manufacturing passenger cars with smaller transmissions which tend to operate with higher energy densities and higher operating temperatures have challenged lubricant suppliers to formulate automatic transmission fluids with new and unique performance characteristics including higher torque.

One of the barriers to successful implementation of the ECCC design for automatic transmissions is transmission shudder. An important factor contributing to shudder is the frictional characteristics of the automatic transmission fluid (ATF). Shudder is undesirable for the durability and operability of the equipment and can result in customer complaints and increased warranty costs. As a result, many original equipment manufacturers (OEMs) are looking for automatic transmission fluids with frictional characteristics capable of meeting the requirements of ECCC designs.

The torque converter is located between the engine and transmission in an automatic transmission. It functions as an engine torque multiplier and a mechanism to transmit engine power through fluid coupling. Most of the recent transmission torque converters are equipped with lock-up clutches (or centrifugal bypass clutches). Lock-up clutches are engaged at highway speeds to reduce the energy loss due to pump/turbine inefficiencies. Further improvements in fuel economy can be achieved if the lock-up clutches are engaged at lower driving speeds. However, it is not possible to dampen the power fluctuations from the engine at low driving speeds if the lock-up clutches are completely engaged. In an ECCC, the lock-up clutch continuously slips while engaged at lower driving speeds and can be locked up (without slippage) at highway speeds. The ECCC design not only reduces the energy losses associated with complete fluid coupling, but also allows power fluctuations to be smoothed. A vehicle equipped with a ECCC is expected to have better fuel efficiency (by approximately 2–10%) compared to that for a conventional lock-up torque converter design transmission.

Vehicles equipped with ECCC transmissions often suffer from the undesirable phenomenon of shudder or self-excited vibration. This vibration is believed to be caused by a "stick-slip" phenomenon, in which two surfaces alternately stick together and slip over each other; two surfaces stick when the lateral force is not great enough to overcome the frictional force and they break loose when the lateral force builds up enough to overcome frictional forces. This oscillatory motion results in periodic vibrations characterized as squawk, shudder, or chatter. Stick-slip is most frequently observed at low sliding speeds and particularly when the coefficient of friction increases with decreasing sliding speed.

From a customer satisfaction view point, it is extremely important that the vehicle does not shudder at any point in its lifetime. OEM data show that shudder is more severe with new friction materials than after the materials are broken in. This means that for factory fill applications, the ATF must show good initial shudder performance before break-in as well as after break-in. Automatic transmission fluids can be tested for shudder using the DEXRON® III ECCC Vehicle Performance Test. The ECCC Vehicle Performance Test runs the vehicle on a dynamometer through a series of pre-determined speed and load conditions. Actual road tests may also be used to detect whether there is shudder in the transmission.

A need exists for an effective way of overcoming the shudder problem associated with the continuous slip torque converter clutches for use in automatic transmissions, especially shudder which occurs with new friction materials before break-in. In fulfilling this need it is also important to ensure that the frictional characteristics needed in the automatic transmission fluid do not materially change with respect to time.

This invention overcomes the shudder problem by providing an automatic transmission fluid that exhibits good anti-shudder performance both initially before break-in as well as after break-in. Moreover these performance advantages are achieved without material change in friction properties over time. Therefore, this invention now makes it possible for the OEMs to make effective use of ECCC designs in automatic transmissions in order to achieve the benefits made possible by such designs.

U.S. Pat. Nos. 5,344,579; 5,372,735; 5,441,656; and 5,578,236 disclose automatic transmission fluid compositions which exhibit good anti-shudder properties. These patents teach that the preferred dispersants are phosphorus and boron containing dispersants although non-phosphorylated, non-boronated dispersants can be used in lieu of or in addition to the phosphorus and boron containing dispersants. These references, however, fail to teach or suggest the specific ratio of nitrogen to phosphorus in the dispersants of the present invention. Further, these references fail to teach or reasonably suggest that automatic transmission fluids containing the dispersants of the present invention, yield compositions which exhibit higher mid-point torque, a higher static torque in shifting clutch applications and better frictional durability as compared to a similar automatic transmission fluid wherein the dispersants have a nitrogen to phosphorus ratio below that of the present invention.

EP 0,747,464 A1 discloses compositions for providing anti-shudder friction durability performance for automatic transmissions. The compositions require a combination of at least three friction modifiers selected from a list of eleven classes of friction modifiers. The publication does not teach or suggest the dispersants of the present invention. Further, the compositions of the present invention do not require the use of at least three friction modifiers in order to obtain good anti-shudder performance.

SUMMARY OF THE INVENTION

In accordance with this invention there is provided, in one of its embodiments, an automatic transmission fluid which contains as an essential component a dispersant having a nitrogen to phosphorus mass ratio between about 3:1 and about 10:1.

The dispersants of the present invention can be prepared in at least two ways. In one method, an ashless dispersant is phosphorylated to such a degree that the nitrogen to phosphorus mass ratio between about 3:1 and about 10:1. In another embodiment, a phosphorylated dispersant and a non-phosphorylated dispersant are blended together such that the total nitrogen to phosphorus mass ratio of the dispersant is between about 3:1 and about 10:1.

In one embodiment, the dispersants of the present invention are used in formulating automatic transmission fluids which exhibit a mid-point torque of at least 185 Nm throughout the duration of the test, as determined by the GM Band Clutch Test (GM performance specification: GM 6417 M, April 1997) run according to DEXRON® III procedures. It has been discovered that by using dispersants having a nitrogen to phosphorus mass ratio between about 3:1 and about 10:1 in combination with at least one friction modifier one can obtain a power transmission fluid which exhibits good anti-shudder properties as well as a higher mid-point torque, a higher static torque in shifting clutch applications and better frictional durability as compared to the properties achieved by a similar automatic transmission fluid containing dispersants having a nitrogen to phosphorus mass ratio of less than 3:1.

In another embodiment of the present invention, a method of eliminating initial shudder in automatic transmissions and a method of providing good anti-shudder durability is set forth. Said methods comprise adding to, and operating in, a transmission an automatic transmission fluid comprising (1) a major amount of a base oil and (2) a minor amount of an additive composition which comprises, as essential components, (A) a dispersant having a nitrogen to phosphorus mass ratio between about 3:1 and about 10:1 and (B) at least one friction modifier, wherein the automatic transmission fluid exhibits a mid-point torque of at least 185 Nm throughout the duration of the test, as determined by the GM Band Clutch Test (GM performance specification: GM 6417 M, April 1997) run according to DEXRON® III procedures. Anti-shudder durability is defined as no significant shudder occuring during the life of the vehicle.

DETAILED DESCRIPTION

Figure 1:
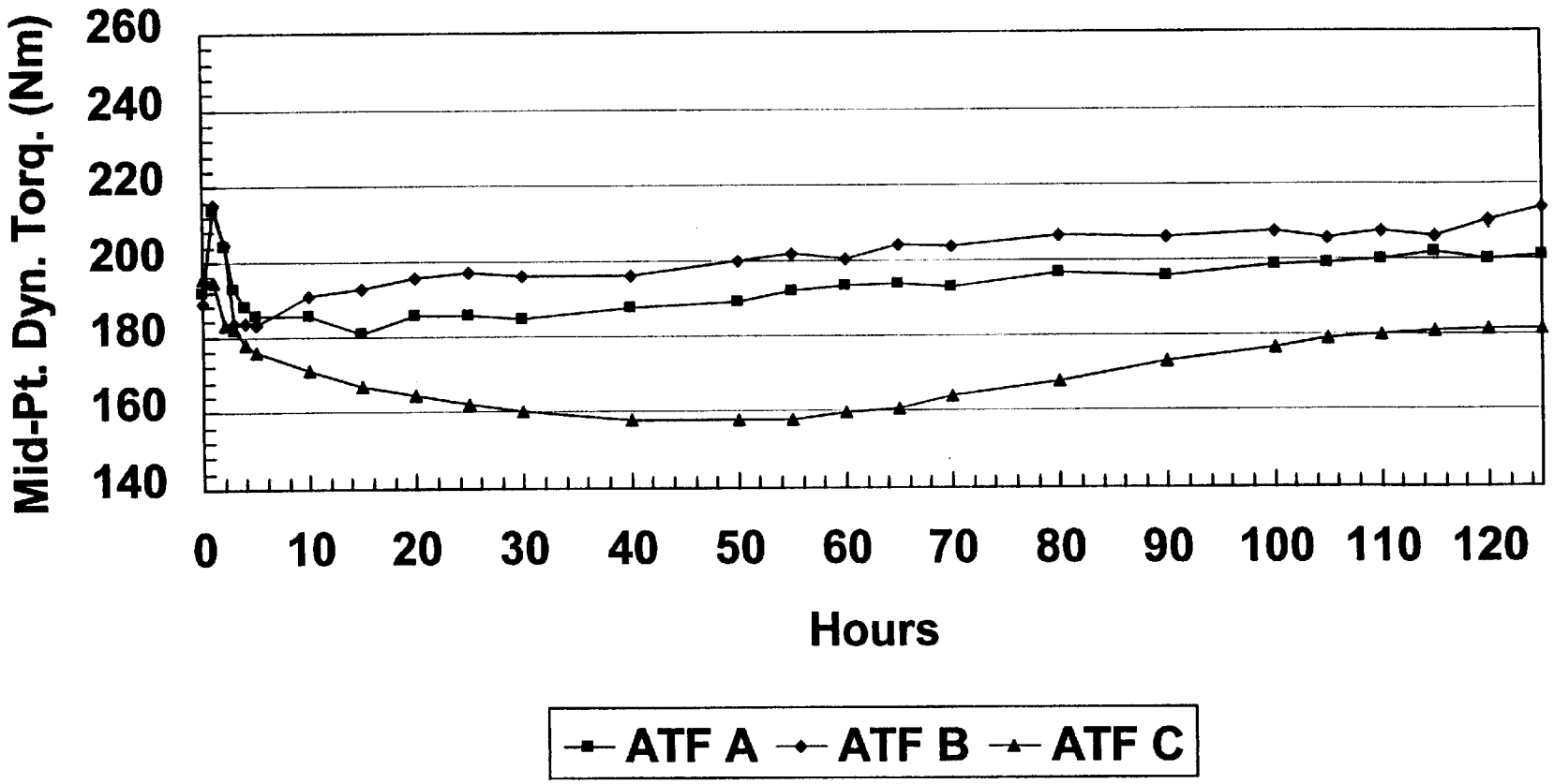
FIGS. 1–8 demonstrate the increased dynamic (mid-point) and maximum torque of automatic transmission fluids of the present invention (ATF A, B and D) compared to automatic transmission fluids outside of the scope of the present invention (ATF C and E) as determined by the GM Band Clutch Test (GM performance specification: GM 6417 M, April 1997) run according to DEXRON® III procedures.

The automatic transmission fluids of the present invention contain, as essential components, (A) a dispersant having a nitrogen to phosphorus mass ratio between about 3:1 and about 10:1 and (B) at least one friction modifier.

Component (A)

Component (A) comprises at least one oil-soluble phosphorus-containing ashless dispersant. The phosphorus-containing ashless dispersants can be formed by phosphorylating an ashless dispersant having basic nitrogen and/or at least one hydroxyl group in the molecule, such as a succinimide dispersant, succinic ester dispersant, succinic ester-amide dispersant, Mannich base dispersant, hydrocarbyl polyamine dispersant, or polymeric polyamine dispersant.

The polyamine succinimides in which the succinic group contains a hydrocarbyl substituent containing at least 30 carbon atoms are described for example in U.S. Pat. Nos. 3,172,892; 3,202,678; 3,216,936; 3,219,666; 3,254,025; 3,272,746; and 4,234,435. The alkenyl succinimides may be formed by conventional methods such as by heating an alkenyl succinic anhydride, acid, acid-ester, acid halide, or lower alkyl ester with a polyamine containing at least one primary amino group. The alkenyl succinic anhydride may be made readily by heating a mixture of olefin and maleic anhydride to, for example, about 180–220° C. The olefin is preferably a polymer or copolymer of a lower monoolefin such as ethylene, propylene, 1-butene, isobutene and the like and mixtures thereof. The more preferred source of alkenyl group is from polyisobutene having a gel permeation chromotography (GPC) number average molecular weight of up to 10,000 or higher, preferably in the range of about 500 to about 2,500, and most preferably in the range of about 800 to about 1,200.

As used herein the term "succinimide" is meant to encompass the completed reaction product from reaction between one or more polyamine reactants and a hydrocarbon-substituted succinic acid or anhydride (or like succinic acylating agent), and is intended to encompass compounds wherein the product may have amide, amidine, and/or salt linkages in addition to the imide linkage of the type that results from the reaction of a primary amino group and an anhydride moiety.

Alkenyl succinic acid esters and diesters of polyhydric alcohols containing 2–20 carbon atoms and 2–6 hydroxyl groups can be used in forming the phosphorus-containing ashless dispersants. Representative examples are described in U.S. Pat. Nos. 3,331,776; 3,381,022; and 3,522,179. The alkenyl succinic portion of these esters corresponds to the alkenyl succinic portion of the succinimides described above.

Suitable alkenyl succinic ester-amides for forming the phosphorylated ashless dispersant are described for example in U.S. Pat. Nos. 3,184,474; 3,576,743; 3,632,511; 3,804,763; 3,836,471; 3,862,981; 3,936,480; 3,948,800; 3,950,341; 3,957,854; 3,957,855; 3,991,098; 4,071,548; and 4,173,540.

Hydrocarbyl polyamine dispersants that can be phosphorylated are generally produced by reacting an aliphatic or alicyclic halide (or mixture thereof) containing an average of at least about 40 carbon atoms with one or more amines, preferably polyalkylene polyamines. Examples of such hydrocarbyl polyamine dispersants are described in U.S. Pat. Nos. 3,275,554; 3,394,576; 3,438,757; 3,454,555; 3,565,804; 3,671,511; and 3,821,302.

In general, the hydrocarbyl-substituted polyamines are high molecular weight hydrocarbyl-N-substituted polyamines containing basic nitrogen in the molecule. The hydrocarbyl group typically has a number average molecular weight in the range of about 750–10,000 as determined by GPC, more usually in the range of about 1,000–5,000, and is derived from a suitable polyolefin. Preferred hydrocarbyl-substituted amines or polyamines are prepared from polyisobutenyl chlorides and polyamines having from 2 to about 12 amine nitrogen atoms and from 2 to about 40 carbon atoms.

Mannich polyamine dispersants which can be utilized in forming the phosphorylated ashless dispersant is a reaction product of an alkyl phenol, typically having a long chain alkyl substituent on the ring, with one or more aliphatic aldehydes containing from 1 to about 7 carbon atoms (especially formaldehyde and derivatives thereof), and polyamines (especially polyalkylene polyamines). Examples of Mannich condensation products, and methods for their production are described in U.S. Pat. Nos. 2,459,112; 2,962,442; 2,984,550; 3,036,003; 3,166,516; 3,236,770; 3,368,972; 3,413,347; 3,442,808; 3,448,047; 3,454,497; 3,459,661; 3,493,520; 3,539,633; 3,558,743; 3,586,629; 3,591,598; 3,600,372; 3,634,515; 3,649,229; 3,697,574; 3,703,536; 3,704,308; 3,725,277; 3,725,480; 3,726,882; 3,736,357; 3,751,365; 3,756,953; 3,793,202; 3,798,165; 3,798,247; 3,803,039; 3,872,019; 3,904,595; 3,957,746; 3,980,569; 3,985,802; 4,006,089; 4,011,380; 4,025,451; 4,058,468; 4,083,699; 4,090,854; 4,354,950; and 4,485,023.

The preferred hydrocarbon sources for preparation of the Mannich polyamine dispersants are those derived from substantially saturated petroleum fractions and olefin polymers, preferably polymers of mono-olefins having from 2 to about 6 carbon atoms. The hydrocarbon source generally contains at least about 40 and preferably at least about 50 carbon atoms to provide substantial oil solubility to the dispersant. The olefin polymers having a GPC number average molecular weight between about 600 and 5,000 are preferred for reasons of easy reactivity and low cost. However, polymers of higher molecular weight can also be used. Especially suitable hydrocarbon sources are isobutylene polymers.

The preferred Mannich base dispersants for this use are Mannich base ashless dispersants formed by condensing about one molar proportion of long chain hydrocarbon-substituted phenol with from about 1 to 2.5 moles of formaldehyde and from about 0.5 to 2 moles of polyalkylene polyamine.

Polymeric polyamine dispersants suitable for preparing phosphorylated ashless dispersants are polymers containing basic amine groups and oil solubilizing groups (for example, pendant alkyl groups having at least about 8 carbon atoms). Such materials are illustrated by interpolymers formed from various monomers such as decyl methacrylate, vinyl decyl ether or relatively high molecular weight olefins, with aminoalkyl acrylates and aminoalkyl acrylamides. Examples of polymeric polyamine dispersants are set forth in U.S. Pat. Nos. 3,329,658; 3,449,250; 3,493,520; 3,519,565; 3,666,730; 3,687,849; and 3,702,300.

The various types of ashless dispersants described above can be phosphorylated by procedures described in U.S. Pat. Nos. 3,184,411; 3,342,735; 3,403,102; 3,502,607; 3,511,780; 3,513,093; 3,513,093; 4,615,826; 4,648,980; 4,857,214 and 5,198,133.

In a preferred embodiment, the phosphorus-containing dispersants of the present invention are also boronated. Methods that can be used for boronating (borating) the various types of ashless dispersants described above are described in U.S. Pat. Nos. 3,087,936; 3,254,025; 3,281,428; 3,282,955; 2,284,409; 2,284,410; 3,338,832; 3,344,069; 3,533,945; 3,658,836; 3,703,536; 3,718,663; 4,455,243; and 4,652,387.

Preferred procedures for phosphorylating and boronating ashless dispersants such as those referred to above are set forth in U.S. Pat. Nos. 4,857,214 and 5,198,133.

The amount of phosphorylated ashless dispersant on an "active ingredient basis" (i.e., excluding the weight of impurities, diluents and solvents typically associated therewith) is generally within the range of about 0.5 to about 7.5 weight percent (wt %), typically within the range of about 0.5 to 5.0 wt %, preferably within the range of about 0.5 to about 3.0 wt %, and most preferably within the range of about 2.0 to about 3.0 wt %.

If the dispersants of the present invention having a nitrogen to phosphorus mass ratio of at least 3:1 are obtained by blending a phosphorylated, and optionally boronated, ashless dispersant with a non-phosphorylated ashless dispersant so as to obtain a dispersant with a total nitrogen to phosphorus mass ratio between about 3:1 and about 10:1, suitable non-phosphorus containing dispersants include the ashless dispersants as described hereinabove. However, the ashless dispersants of component (B) are not phosporylated. The amount of non-phosphorylated ashless dispersant on an "active ingredient basis" (i.e., excluding the weight of impurities, diluents and solvents typically associated therewith) is generally within the range of about 0.5 to about 7.5 wt %, typically within the range of about 0.5 to about 4.0 wt %, and preferably within the range of about 1.0 to about 3.5 wt %.

The relative proportions of phosphorylated ashless dispersant to non-phosphorylated ashless dispersant are preferably 1:10 to 10:1, more preferably 1:5 to 5:1, and most preferably 2:1 to 1:2, based on weight percent. Again, any proportions are suitable so long as the nitrogen to phosphorus ratio for the total dispersant is between about 3:1 and about 10:1.

In one preferred embodiment, the dispersant (A) has a nitrogen to boron mass ratio of from 5:1 to about 15:1.

Component (B)

The compositions of the present invention contain one or more friction modifiers. These include such compounds as fatty amines or ethoxylated fatty amines, aliphatic fatty acid amides, ethoxylated aliphatic ether amines, aliphatic carboxylic acids, glycerol esters, aliphatic carboxylic esteramides, aliphatic phosphonates, aliphatic phosphates, aliphatic thiophosphonates, aliphatic thiophosphates, fatty imidazolines, fatty tertiary amines etc., wherein the aliphatic group usually contains above about eight carbon atoms so as to render the compound suitably oil soluble. Also suitable are aliphatic substituted succinimides formed by reacting one or more aliphatic succinic acids or anhydrides with ammonia or other primary amines.

One preferred group of friction modifiers is comprised of the N-aliphatic hydrocarbyl-substituted diethanol amines in which the N-aliphatic hydrocarbyl-substituent is at least one straight chain aliphatic hydrocarbyl group free of acetylenic unsaturation and having in the range of about 14 to about 20 carbon atoms.

A particularly preferred friction modifier system is composed of a combination of at least one N-aliphatic hydrocarbyl-substituted diethanol amine and at least one N-aliphatic hydrocarbyl-substituted trimethylene diamine in which the N-aliphatic hydrocarbyl-substituent is at least one straight chain aliphatic hydrocarbyl group free of acetylenic unsaturation and having in the range of about 14 to about 20 carbon atoms. Further details concerning this friction modifier system are set forth in U.S. Pat. Nos. 5,372,735 and 5,441,656, incorporated herein by reference.

Another particularly preferred friction modifier system is based on the combination of (i) at least one di(hydroxyalkyl) aliphatic tertiary amine in which the hydroxyalkyl groups, being the same or different, each contain from 2 to about 4 carbon atoms, and in which the aliphatic group is an acyclic hydrocarbyl group containing from about 10 to about 25 carbon atoms, and (ii) at least one hydroxyalkyl aliphatic imidazoline in which the hydroxyalkyl group contains from 2 to about 4 carbon atoms, and in which the aliphatic group is an acyclic hydrocarbyl group containing from about 10 to about 25 carbon atoms. Further details concerning this friction modifier system are set forth in U.S. Pat. No. 5,344,579, incorporated herein by reference.

Component (i), the di(hydroxyalkyl) aliphatic tertiary amine, has a nitrogen atom to which are bonded two hydroxyalkyl groups and one non-cyclic aliphatic hydrocarbyl group having 10 to 25 carbon atoms, and preferably 13 to 19 carbon atoms. The hydroxyalkyl groups of these tertiary amines can be the same or different, but each contains from 2 to 4 carbon atoms. The hydroxyl groups can be in any position in the hydroxyalkyl groups, but preferably are in the β-position. Preferably the two hydroxyalkyl groups in component (i) are the same, and most preferably are 2-hydroxyethyl groups. The aliphatic group of these tertiary amines can be straight or branched chain and it can be saturated or olefinically unsaturated and if unsaturated, it typically contains from one to three olefinic double bonds. Component (i) can have a single type of aliphatic group or it can comprise a mixture of compounds having different aliphatic groups in which the average number of carbon atoms falls within the foregoing range of from 10 to 25 carbon atoms.

From the foregoing it will be clear that component (i) can be a single compound or a mixture of compounds meeting the structural criteria described above.

The hydroxyalkyl aliphatic imidazolines, component (ii), suitable for use in the practice of this invention are characterized by having in the 1-position on the imidazoline ring a hydroxyalkyl group that contains from 2 to 4 carbon atoms, and by having in the adjacent 2-position on the ring a non-cyclic hydrocarbyl group containing 10 to 25 carbon atoms. While the hydroxyl group of the hydroxyalkyl group can be in any position thereof, it preferably is on the 3-carbon atom, such as 2-hydroxyethyl, 2-hydroxypropyl or 2-hydroxybutyl. Typically the aliphatic group is a saturated or olefinically unsaturated hydrocarbyl group, and when olefinically unsaturated, the aliphatic group may contain one, two or three such double bonds. Component (ii) may be a single substantially pure compound or it may be a mixture of compounds in which the aliphatic group has an average of from 10 to 25 carbon atoms. Preferably the aliphatic group has 15 to 19 carbon atoms, or an average of 15 to 19 carbon atoms. Most preferably the aliphatic group has, or averages, 17 carbon atoms. The aliphatic group(s) may be straight or branched chain groups, with substantially straight chain groups being preferred. A particularly preferred compound is 1-hydroxyethyl-2-heptadecenyl imidazoline.

It will thus be clear that component (ii) can be a single compound or a mixture of compounds meeting the structural criteria described above.

Generally speaking, the compositions of this invention will contain up to about 1.25 wt % on an active ingredient basis, and preferably from about 0.05 to about 1 wt % on an active ingredient basis of one or more friction modifiers.

Component (C)

The compositions of the present invention optionally, but preferably, contain a viscosity index improver (VII). Preferred VIIs include, but are not limited to, olefin copolymer VIIs, polyalkylmethacrylate VIIs and styrene-maleic ester VIIs. Of these, polyalkylmethacrylate VIIs are particularly preferred. The viscosity index improver is supplied in the form of a solution in an inert solvent, typically a mineral oil solvent, which usually is a severely refined mineral oil. The viscosity index improver solution as received often will have a boiling point above 200° C., and a specific gravity of less than 1 at 25° C. Preferably, the viscosity index improver will have sufficient shear stability such that the finished composition possesses a kinematic viscosity of at least 5, and more preferably at least 6.8, cSt at 100° C. after 40 cycles in the FISST (Fuel Injector Shear Stability Test) of ASTM D-5275. On an active ingredient basis (i.e., excluding the weight of inert diluent or solvent associated with the viscosity index improver as supplied), the finished fluid compositions of this invention will normally contain in the range of about 1 to about 20 wt % of the polymeric viscosity index improver. Small departures from this range may be resorted to as necessary or desirable in any given situation.

Suitable materials for use as component (C) include styrene-maleic ester VIIs such as LUBRIZOL® 3702, LUBRIZOL® 3706 and LUBRIZOL® 3715 available from The Lubrizol Corporation; polyalkylmethacrylate VIIs such as those available from RÖHM GmbH (Darmstadt, Germany) under the trade designations: VISCOPLEX® 5543, VISCOPLEX® 5548, VISCOPLEX® 5549, VISCOPLEX® 5550, VISCOPLEX® 5551 and VISCOPLEX® 5151, from Rohm & Haas Company (Philadelphia, Pa.) under the trade designations ACRYLOID® 1277, ACRYLOID® 1265 and ACRYLOID® 1269, and from Ethyl Corporation (Richmond, Va.) under the trade designation HiTEC® 5710 viscosity index improver; and olefin copolymer VIIs such as HiTEC® 5747 VII, HiTEC® 5751 VII, HiTEC® 5770 VII and HiTEC® 5772 VII available from Ethyl Corporation and SHELLVIS® 200 available from Shell Chemical Company. Mixtures of the foregoing products can also be used as well as dispersant and dispersant/antioxidant VIIs. It is possible that other manufacturers may also have viscosity index improvers having the requisite performance properties required for use as component (C). Details concerning the chemical composition and methods for the manufacture of such products are maintained as trade secrets by manufacturers of such products.

Preferably, the viscosity index improver will be provided as a hydrocarbon solution having a polymer content in the range of from about 25 to about 80 wt % and a nitrogen content in the range of about 0 to about 0.5 wt %. Such products preferably exhibit a permanent shear stability index (a PSSI value) using ASTM test method D-3945A of no higher than about 75, preferably 50 or less, and most preferably 35 or less.

The automatic transmission fluids of the present invention may further include seal swell agents, antioxidants, corrosion inhibitors, foam inhibitors, copper corrosion inhibitors, anti-wear/extreme pressure additives, lubricity agents, and dyes.

In selecting any of the foregoing optional additives, it is important to ensure that the selected component(s) is/are soluble or stably dispersible in the additive package and finished ATF composition, are compatible with the other components of the composition, and do not interfere significantly with the performance properties of the composition, such as the friction, viscosity and/or shear stability properties, needed or at least desired in the overall finished composition.

In general, the ancillary additive components are employed in the oils in minor amounts sufficient to improve the performance characteristics and properties of the base fluid. The amounts will thus vary in accordance with such factors as the viscosity characteristics of the base fluid employed, the viscosity characteristics desired in the finished fluid, the service conditions for which the finished fluid is intended, and the performance characteristics desired in the finished fluid. However, generally speaking, the following concentrations (mass percent) of the additional components (active ingredients) in the base fluids are illustrative:

| | Typical Range | Preferred Range |
|---|---|---|
| Total dispersant | 1–15 | 1–8 |
| Friction Modifier(s) | 0.05–1.25 | 0.05–1 |
| Viscosity Index Improver | 0–20 | 0–10 |
| Seal swell agent | 0–30 | 0–20 |
| Antioxidant | 0–1 | 0.25–1 |
| Corrosion inhibitor | 0–0.5 | 0.01–0.1 |
| Foam inhibitor | 0–0.01 | 0.0001–0.005 |
| Copper corrosion inhibitor | 0–0.5 | 0.01–0.05 |
| Anti-wear/extreme pressure | 0–1 | 0.25–1 |
| Lubricity agent | 0–1.5 | 0.5–1 |
| Dye | 0–0.05 | 0.015–0.035 |

It will be appreciated that the individual components employed can be separately blended into the base fluid or can be blended therein in various subcombinations, if desired. Ordinarily, the particular sequence of such blending steps is not critical. Moreover, such components can be blended in the form of separate solutions in a diluent. It is preferable, however, to blend the additive components used in the form of a concentrate, as this simplifies the blending operations, reduces the likelihood of blending errors, and takes advantage of the compatibility and solubility characteristics afforded by the overall concentrate.

Additive concentrates can thus be formulated to contain all of the additive components and if desired, some of the base oil component, in amounts proportioned to yield finished fluid blends consistent with the concentrations described above. In most cases, the additive concentrate will contain one or more diluents such as light mineral oils, to facilitate handling and blending of the concentrate. Thus concentrates containing up to about 50% by weight of one or more diluents or solvents can be used, provided the solvents are not present in amounts that interfere with the low and high temperature and flash point characteristics and the performance of the finished power transmission fluid composition. In this connection, the additive components utilized pursuant to this invention should be selected and proportioned such that an additive concentrate or package formulated from such components will have a flash point of 170 ° C. or above, and preferably a flash point of at least 180° C., using the ASTM D-92 test procedure.

Very small amounts of certain metal-containing detergents, such as calcium sulfurized phenates, can also be used. However, if an oil-soluble phenate is used it should be proportioned such that the finished fluid contains no more than about 250 ppm of metal, preferably no more than about 100 ppm of metal, and most preferably no more than about 50 ppm of metal. These sulfurized phenates are preferably neutral salts containing a stoichiometric amount of calcium, and in any event should have a total base number (TBN) of not more than about 200 mg KOH/gram.

When the phosphorus content of the finished fluid is not completely supplied by use of a phosphorus-containing ashless dispersant (or a boron- and phosphorus-containing ashless dispersant), the remainder of the phosphorus content is preferably supplied by inclusion in the composition of one or more phosphorus-containing esters or acid-esters such as oil-soluble organic phosphites, oil-soluble organic acid phosphites, oil-soluble organic phosphates, oil-soluble organic acid phosphates, oil-soluble phosphoramidates. Examples include trihydrocarbyl phosphates, trihydrocarbyl phosphites, dihydrocarbyl phosphates, dihydrocarbyl phosphonates or dihydrocarbyl phosphites or mixtures thereof, monohydrocarbyl phosphates, monohydrocarbyl phosphites, and mixtures of any two or more of the foregoing. Oil-soluble amine salts of organic acid phosphates are a preferred category of auxiliary phosphorus-containing additives for use in the fluids of this invention. Sulfur-containing analogs of any of the foregoing compounds can also be used, but are less preferred. Most preferred as a commercially-available auxiliary phosphorus additive is an amine phosphate antiwear/extreme pressure agent available from Ciba-Geigy Corporation as Irgalube® 349.

Thus, in one of its embodiments, this invention provides compositions which contain a phosphorus- and boron-containing ashless dispersant such as a succinimide, together with at least one phosphorus-containing substance selected from (1) one or more inorganic acids of phosphorus; or (2) one or more inorganic thioacids of phosphorus; or (3) one or more monohydrocarbyl esters of one or more inorganic acids of phosphorus; or (4) one or more monohydrocarbyl esters of one or more inorganic thioacids of phosphorus; or (5) any combination thereof; or at least one oil-soluble amine salt or complex or adduct of any of (1), (2), (3), (4), and (5), said amine optionally being in whole or in part an amine moiety in a phosphorus-, boron- and basic nitrogen-containing ashless dispersant such as a succinimide.

The boron content of the compositions of this invention is preferably supplied by use of a boron- and phosphorus-containing ashless dispersant. When the boron content of the finished fluid is not completely supplied in this manner, the remainder of the boron content can be supplied by inclusion in the composition of one or more oil-soluble boron esters such as a glycol borate or glycol biborate.

The base oils used in forming the automatic transmission fluids of this invention can be any suitable natural or synthetic oil having the necessary viscosity properties for this usage. Natural oils include animal oils and vegetable oils (e.g., castor oil, lard oil etc.), liquid petroleum oils and hydrorefined, severely hydrotreated, iso-dewaxed, solvent-treated or acid-treated mineral lubricating oils of the paraffinic, naphthenic and mixed paraffinic-naphthenic types. Oils of lubricating viscosity derived from coal or shale are also useful base oils. The synthetic lubricating oils suitable for use in this invention include one of any number of commonly used synthetic hydrocarbon oils, which include, but are not limited to, poly-alpha-olefins, synthetic esters, alkylated aromatics, alkylene oxide polymers, interpolymers, copolymers and derivatives thereof where the terminal hydroxyl groups have been modified by esterification, etherification etc., esters of dicarboxylic acids and silicon-based oils. Thus, the base oil may be composed entirely of a natural oil such as mineral oil of suitable viscosity or it may be composed entirely of a synthetic oil such as a poly-alpha-olefin oligomer of suitable viscosity. Likewise, the base oil may be a blend of natural and synthetic base oils provided that the blend has the requisite properties for use in the formation of an automatic transmission fluid. Ordinarily, the base oil should have a kinematic viscosity in the range of 3 to 8 centistokes (cSt) at 100° C. Preferred automatic transmission fluids used in the practice of this invention can be formulated without a viscosity index improver so as to possess a kinematic viscosity of at least 4.0 cSt at 100° C. and a Brookfield viscosity of no more than 20,000 cP at −40° C., or formulated using a viscosity index improver so as to possess a kinematic viscosity of at least 5.0, and preferably at least 6.8, cSt at 100° C. and a Brookfield viscosity of no more than 20,000 cP at −40° C.

EXAMPLES

The friction properties of an ATF can be evaluated by following the DEXRON® III and MERCON® friction procedures on an SAE No. 2 friction machine. Profiles of the low-speed (maximum) and dynamic (mid-point) torques and engagement times are obtained during the 100 hour test which encompasses 24,000 cycles. To pass the test the mid-point dynamic torque of an ATF has to lie between 150–180 Nm, whereas the engagement time has to be between 0.45–0.60 sec. The DEXRON® III Band Clutch Test (GM performance specification: GM 6417 M, April 1997) involves engaging the clutch at the rate of four cycles per minute for 100 hours (i.e., 24,000 cycles) at 135° C. The DEXRON® III Band Clutch Test limit for the mid-point torque is 185–220 Nm.

Illustrative compositions suitable for use in the practice of this invention are presented in the following Examples 1–3, wherein all parts and percentages are by weight. Component (A') is a polyisobutenyl (PIB) succinimide dispersant, wherein the PIB has a number average molecular weight of approximately 900, containing both phosphorus and boron and is formed substantially as described in Example 1A of U.S. Pat. No. 4,857,214. Component (A'") is a non-phosphorylated, non-boronated polyisobutenyl succinimide dispersant, wherein the PIB has a number average molecular weight of approximately 900. Friction modifier (i) is a hydroxyalkyl aliphatic imidazoline, and friction modifier (ii) is di(hydroxyalkyl) aliphatic tertiary amine. Comparative Example 2 (ATF E) contains the same dispersant/friction modifier composition as taught in U.S. Pat. No. 5,344,579. All formulations contained commercially available supplemental additives, such as viscosity index improvers, seal swell agents, antioxidants, corrosion inhibitors, foam inhibitors, anti-wear/extreme pressure agents and lubricity agents, used in their conventional amounts. The base oil for ATFs A, B, D and E was a 100N mineral oil. The base oil for ATF C was a blend of 70N and 100N mineral oil. All weights are based on active ingredients.

Example 1 (ATF A)

| Component | Wt. % in ATF |
|---|---|
| Component (A') | 1.51 |
| Component (A") | 2.92 |
| Friction modifier (i) | 0.05 |
| Friction modifier (ii) | 0.10 |
| N:P ratio of dispersants | 6:1 |

Example 2 (ATF B)

| Component | Wt. % in ATF |
|---|---|
| Component (A') | 1.51 |
| Component (A") | 2.92 |
| Friction modifier (i) | 0.05 |
| Friction modifier (ii) | 0.10 |
| N:P ratio of dispersants | 6:1 |

Example 3 (ATF D)

| Component | Wt. % in ATF |
|---|---|
| Component (A') | 1.51 |
| Component (A") | 1.10 |
| Friction modifier (i) | 0.02 |
| Friction modifier (ii) | 0.12 |
| N:P ratio of dispersants | 3.6:1 |

Comparative Example 1 (ATF C)

| Component | Wt. % in ATF |
|---|---|
| Component (A') | 2.07 |
| Component (A") | 0.00 |
| Friction modifier (ii) | 0.15 |
| N:P ratio of dispersant | 2.15:1 |

Compative Example 2 (ATF E)

| Component | Wt. % in ATF |
|---|---|
| Component (A') | 2.07 |
| Component (A") | 0.00 |
| Friction modifier (i) | 0.05 |
| Friction Modifier (ii) | 0.10 |
| N:P ratio of dispersant | 2.15:1 |

All of the above ATF compositions A-E in Examples 1–3 and Comparative Examples 1 and 2 demonstrated good anti-shudder performance as exhibited by no initial shudder and good anti-shudder durability. However, inventive ATF compositions A, B and D (Examples 1–3) exhibit a higher mid-point torque, a higher static torque in shifting clutch applications and better frictional durability compared to ATF C and ATF E (Comparative Examples 1 and 2 respectively), wherein the dispersant has a nitrogen to phosphorus ratio of less than 3:1.

Figure 2:
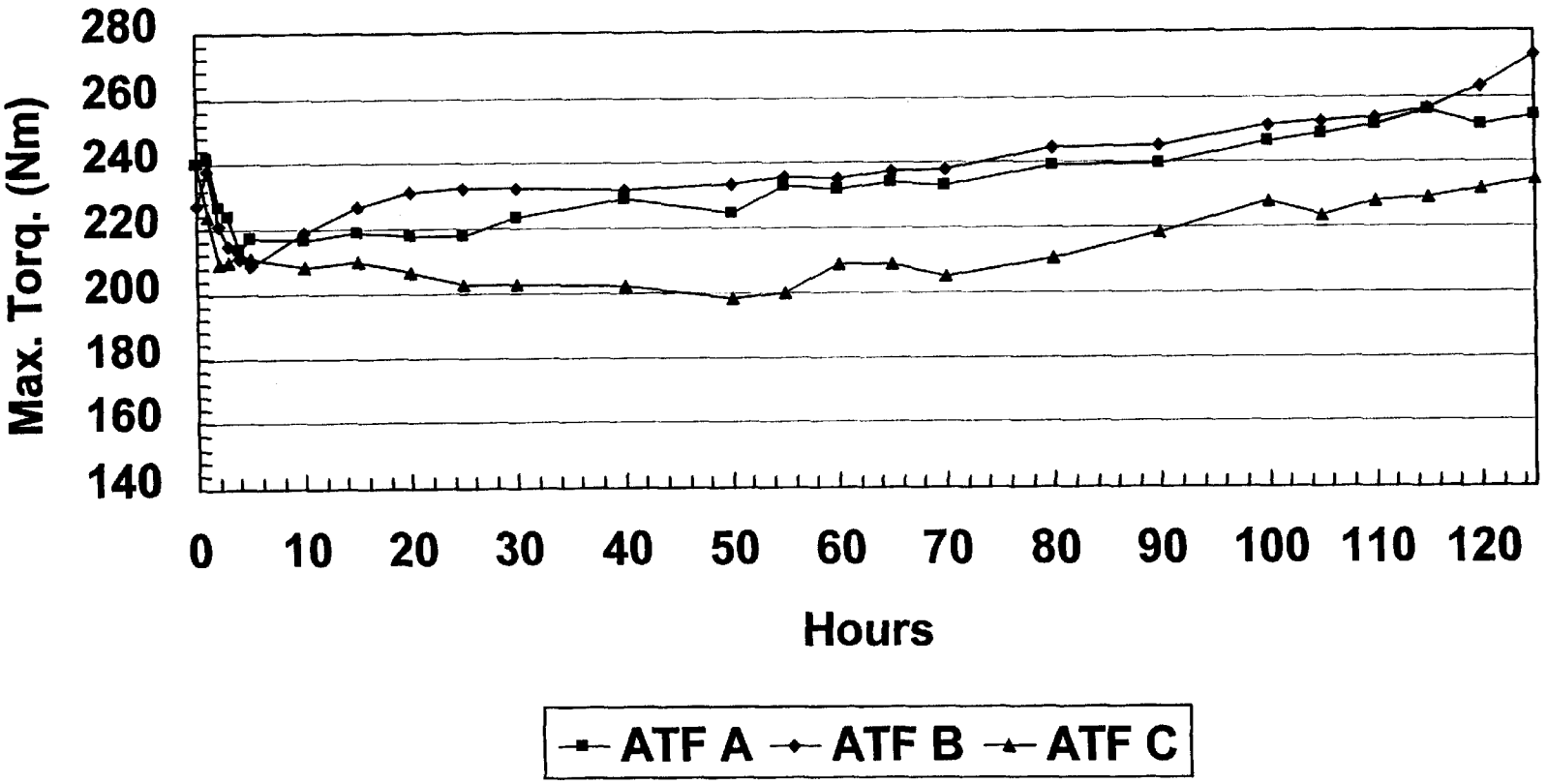

The band friction materials used in the tests exemplified in FIGS. 1 and 2 are composed of a different friction material than the bands used in FIGS. 3–8, therefore the mid-point torque and maximum torque for ATF C appears different when comparing FIG. 1 to FIGS. 3 or 5 and FIG. 2 to FIGS. 4 or 6. All GM Band Clutch Tests were run according to Dexron® III procedures.

In FIG. 1, ATF compositions A, B and C were tested in the GM Band Clutch Test using a band friction material (BW 1301) not within the Dexron® III specifications. The mid-point torque for the compositions was determined and plotted as a function of time. It is clear, upon examination of this data, that the ATF compositions containing dispersants having a nitrogen to phosphorus mass ratio of at least 3:1 (ATF A and B) exhibit a desirably higher mid-point torque, throughout the duration of the test, than a similar ATF composition (ATF C) which contains a dispersant having a nitrogen to phosphorus mass ratio of less than 3:1.

In FIG. 2, ATF compositions A, B and C were tested in the GM Band Clutch Test using the same band friction material as in FIG. 1. The maximum torque for the compositions was determined and plotted as a function of time. It is clear, upon examination of this data, that the inventive ATF compositions containing dispersants having a nitrogen to phosphorus mass ratio of at least 3:1 (ATF A and B) exhibit an unexpectedly higher maximum (low speed) torque, throughout the duration of the test, than a similar ATF composition (ATF C) which contains a dispersant having a nitrogen to phosphorus mass ratio of less than 3:1.

Figure 3:
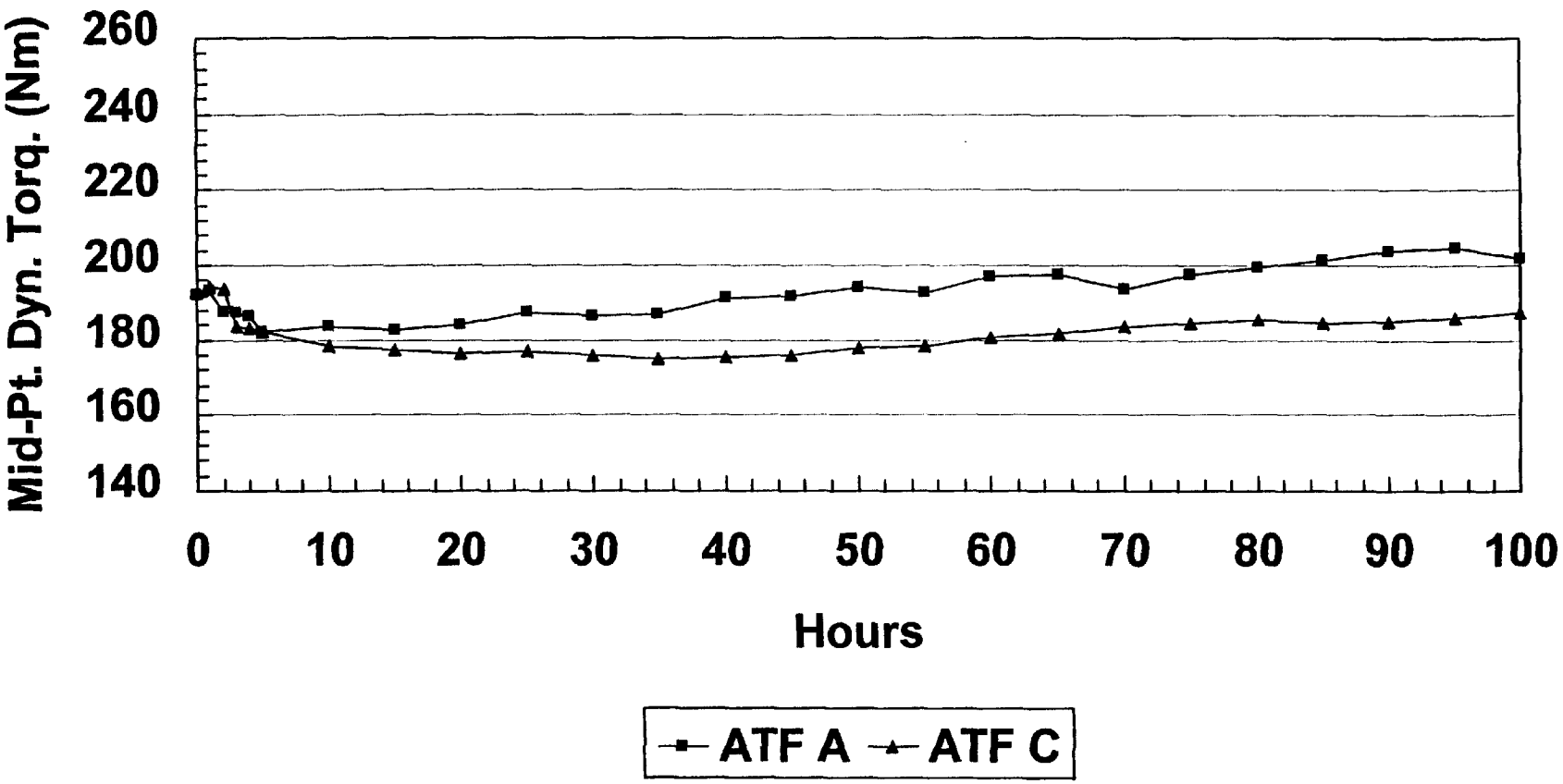

In FIG. 3, ATF compositions A and C were tested in the GM Band Clutch Test using a BW 1473-2 band according to Dexron® III procedures. The mid-point torque for the compositions was determined and plotted as a function of time. It is clear, upon examination of this data, that the ATF composition containing a dispersant having a nitrogen to phosphorus mass ratio of at least 3:1 (ATF A) exhibits a higher mid-point torque throughout the duration of the test than a similar ATF composition (ATF C) which contains a dispersant having a nitrogen to phosphorus mass ratio of less than 3:1.

Figure 4:
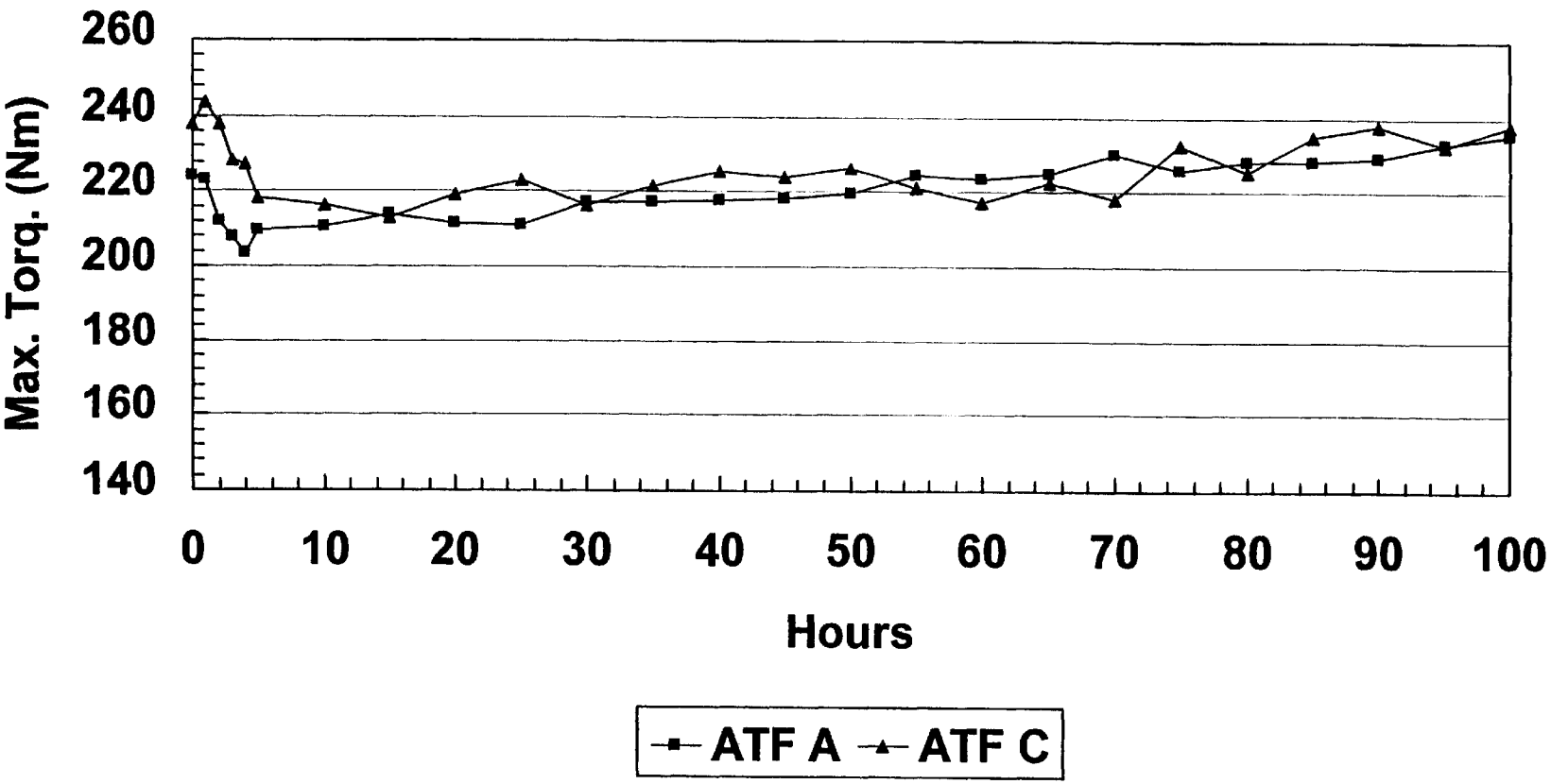

In FIG. 4, ATF compositions A and C were tested in the GM Band Clutch Test using a BW 1473-2 band according to Dexron® III procedures. The maximum torque for the compositions was determined and plotted as a function of time. It is clear, upon examination of this data, that the inventive ATF composition containing a dispersant having a nitrogen to phosphorus mass ratio between about 3:1 and about 10:1 (ATF A) exhibits a higher maximum (low speed) torque, throughout the duration of the test, compared to a similar ATF composition (ATF C) which contains a dispersant having a nitrogen to phosphorus mass ratio of less than 3:1.

Figure 5:
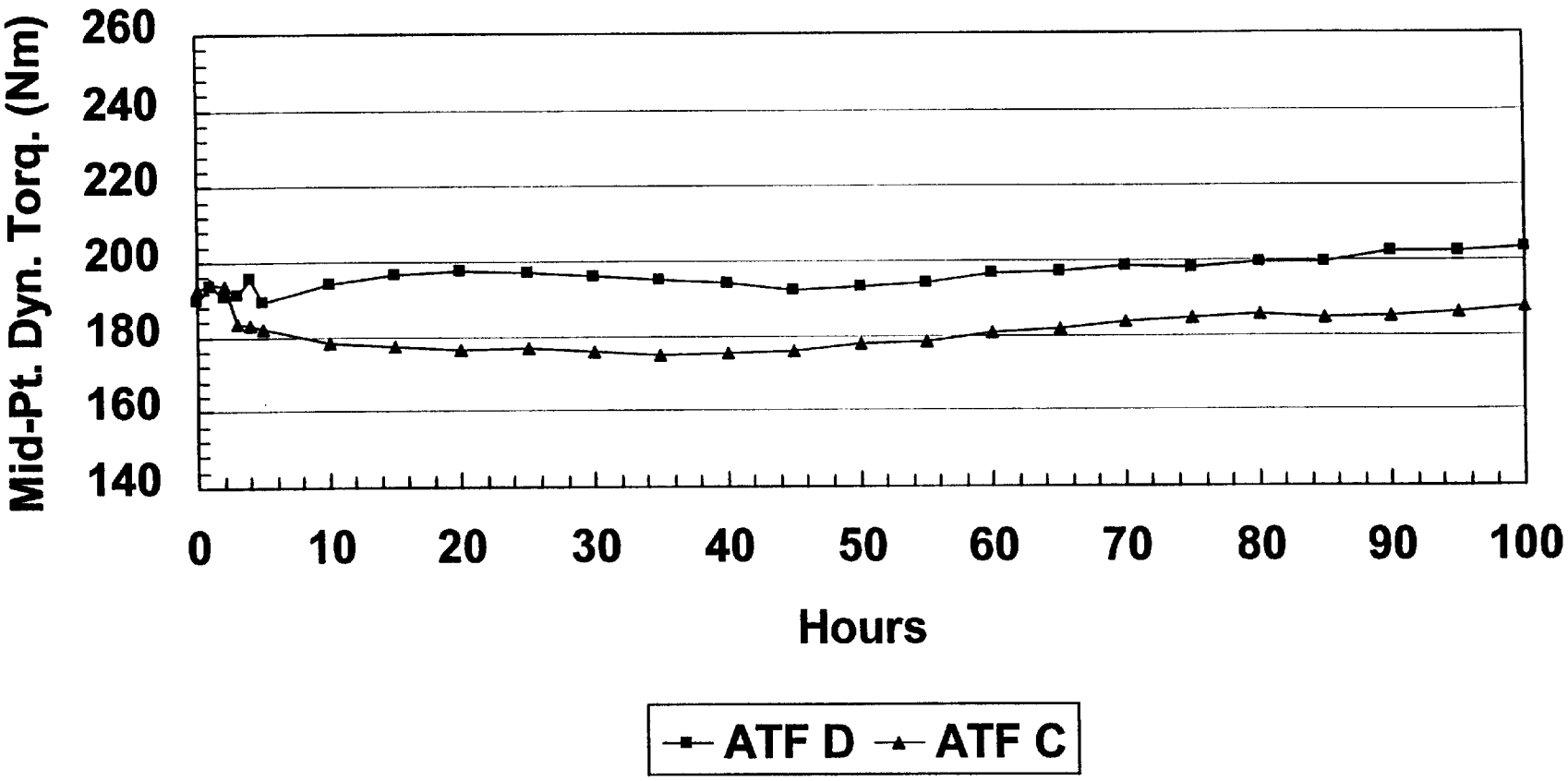

In FIG. 5, ATF compositions C and D were tested in the GM Band Clutch Test using a BW 1473-2 band according to Dexron® III procedures. The mid-point torque for the compositions was determined and plotted as a function of time. It is clear, upon examination of this data, that the ATF composition containing a dispersant having a nitrogen to phosphorus mass ratio between about 3:1 and about 10:1 (ATF D) exhibits a higher mid-point torque throughout the duration of the test than a similar ATF composition (ATF C) which contains a dispersant having a nitrogen to phosphorus mass ratio of less than 3:1.

Figure 6:
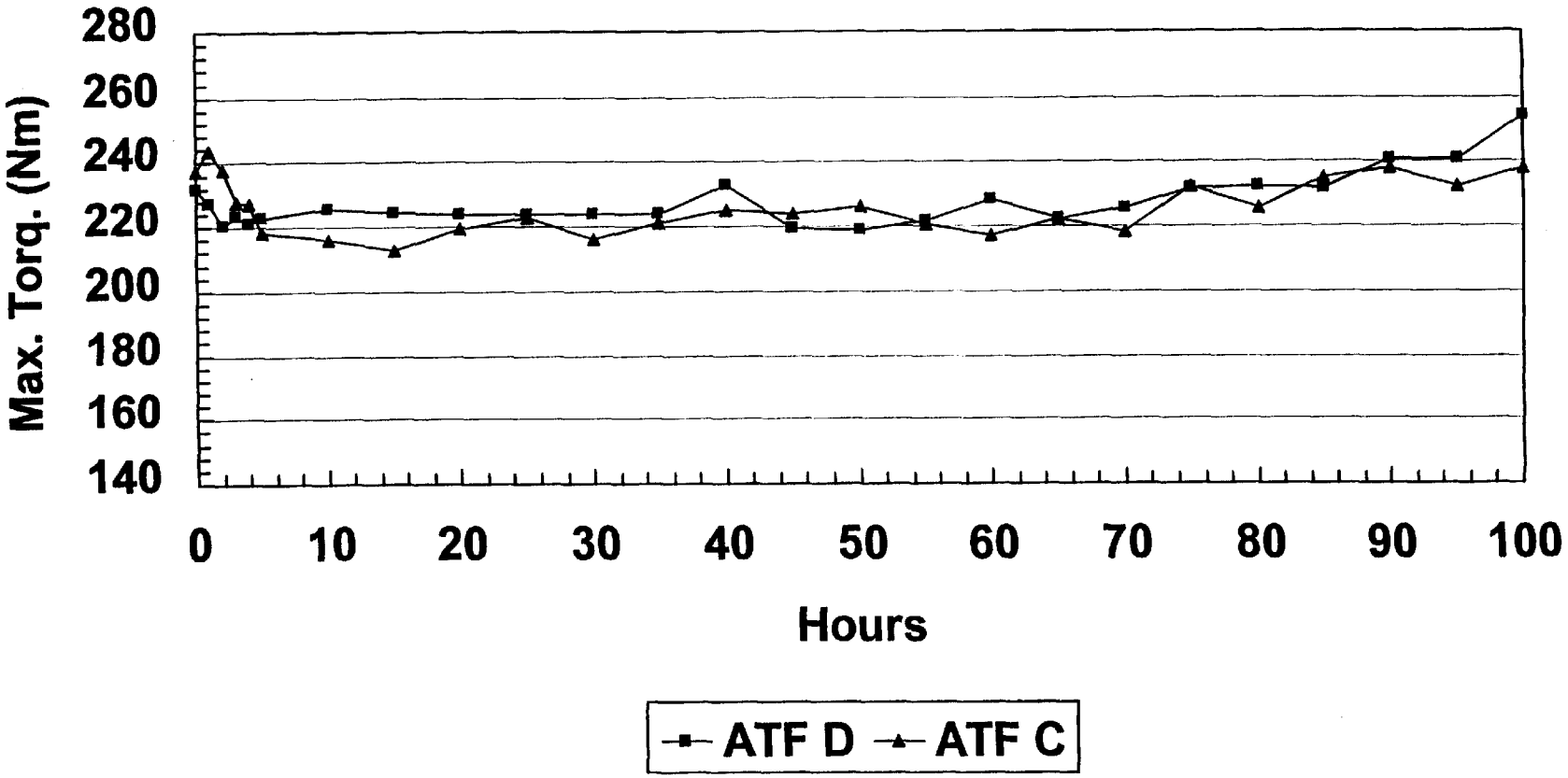

In FIG. 6, ATF compositions C and D were tested in the GM Band Clutch Test using a BW 1473-2 band according to Dexron® III procedures. The maximum torque for the compositions was determined and plotted as a function of time. It is clear, upon examination of this data, that the inventive ATF composition containing a dispersant having a nitrogen to phosphorus mass ratio between about 3:1 and about 10:1 (ATF D) exhibits a higher maximum (low speed) torque, throughout the duration of the test, compared to a similar ATF composition (ATF C) which containing a dispersant having a nitrogen to phosphorus mass ratio of less than 3:1.

Figure 7:
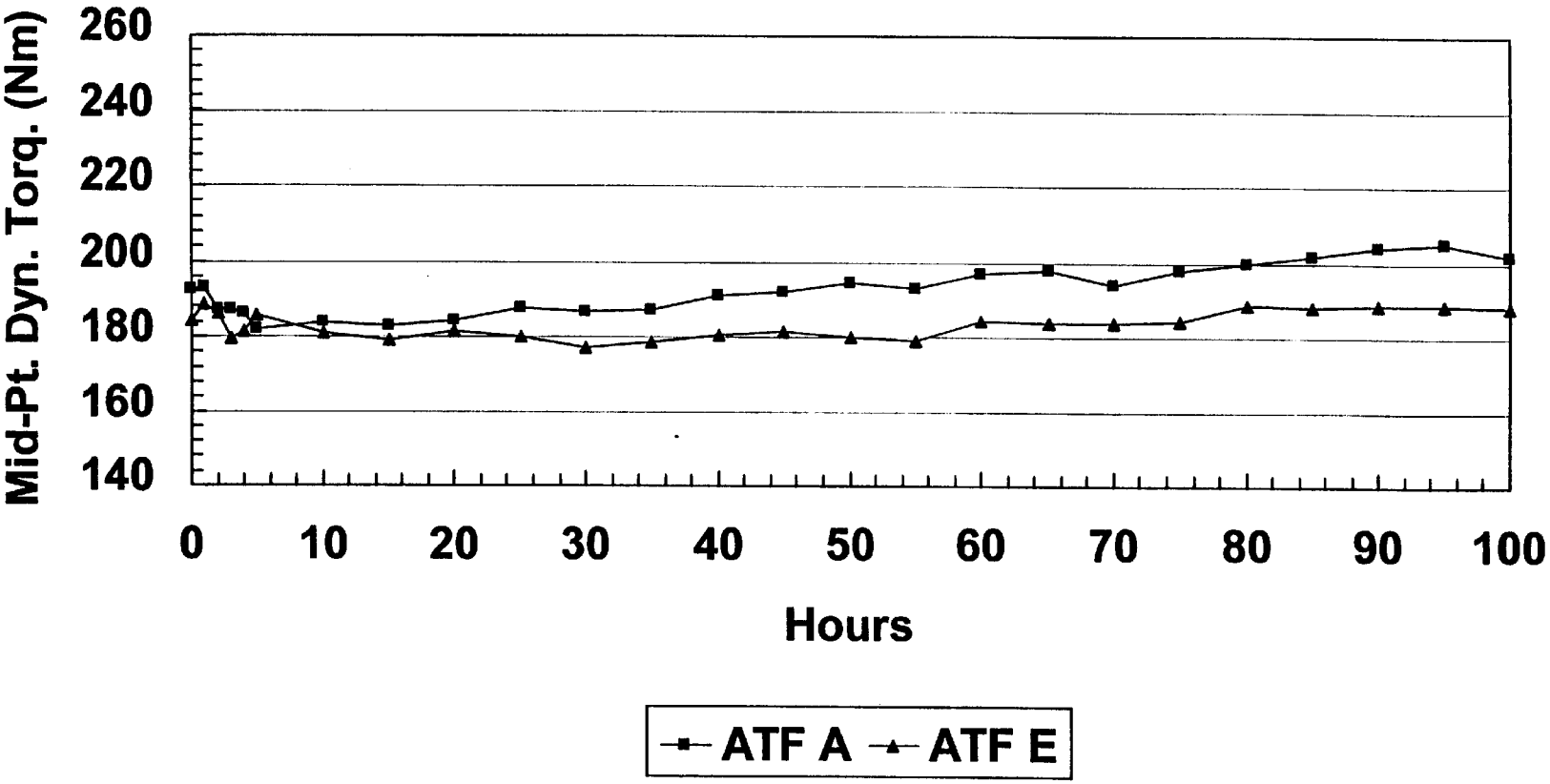

In FIG. 7, ATF compositions A and E were tested in the GM Band Clutch Test using a BW 1473-2 band according to Dexron® III procedures. The mid-point torque for the compositions was determined and plotted as a function of time. It is clear, upon examination of this data, that the ATF composition containing a dispersant having a nitrogen to phosphorus mass ratio between about 3:1 and about 10:1 (ATF A) exhibits a higher mid-point torque throughout the duration of the test than a similar ATF composition (ATF E) which contains a dispersant having a nitrogen to phosphorus mass ratio of less than 3:1.

Figure 8:
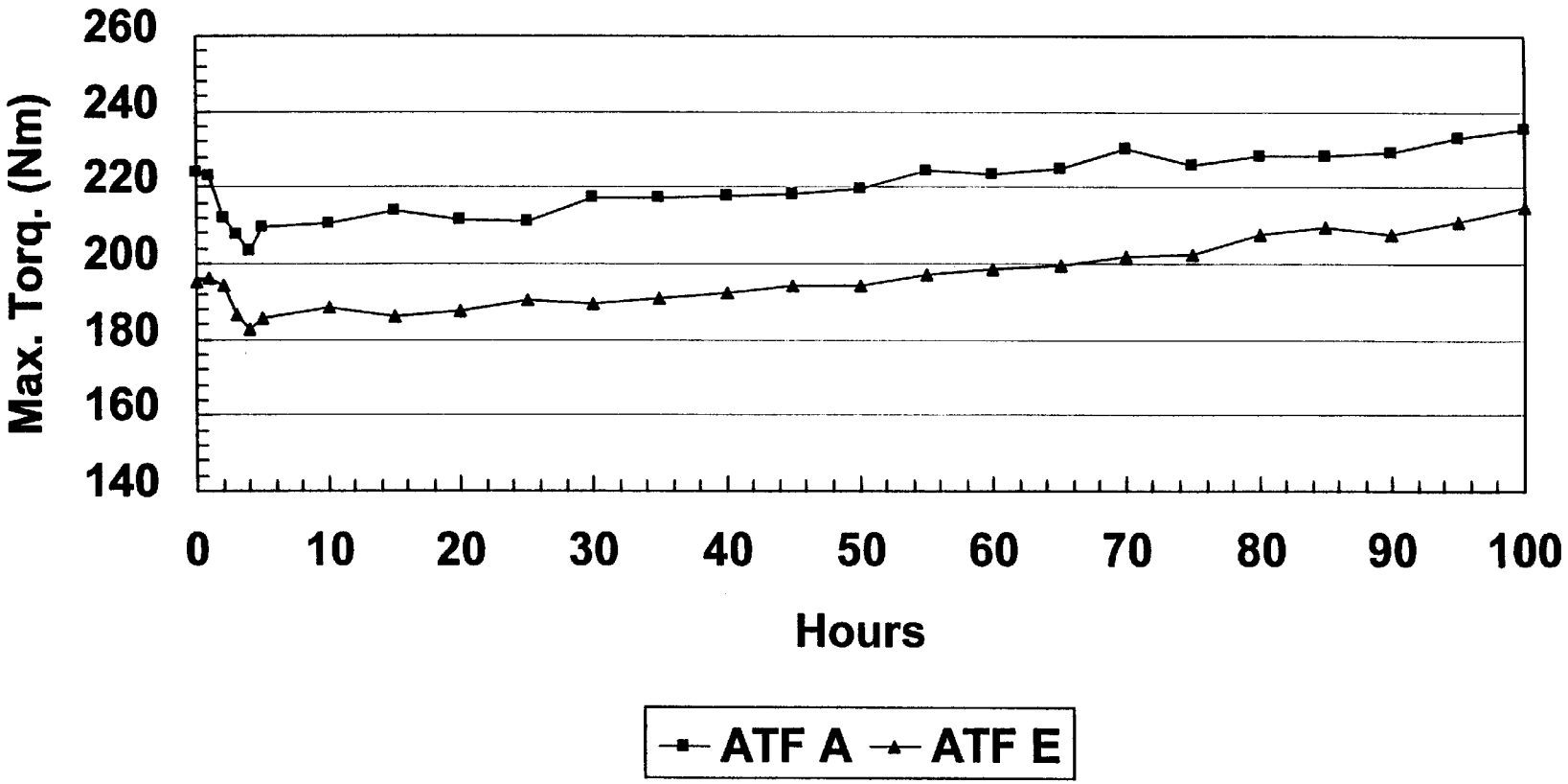

In FIG. 8, ATF compositions A and E were tested in the GM Band Clutch Test using a BW 1473-2 band according to Dexron® III procedures. The maximum torque for the compositions was determined and plotted as a function of time. It is clear, upon examination of this data, that the inventive ATF composition containing a dispersant having a nitrogen to phosphorus mass ratio between about 3:1 and about 10:1 (ATF A) exhibits a higher maximum (low speed) torque, throughout the duration of the test, compared to a similar ATF composition (ATF E) which containing a dispersant having a nitrogen to phosphorus mass ratio of less than 3:1.

It is clear, upon examination of the data presented, that the compositions of the present invention exhibit unexpectedly higher mid-point and maximum torque values as compared to compositions outside the scope of the present invention (i.e., ATF fluids containing a dispersant having a nitrogen to phosphorus mass ratio of less than 3:1). Thus it is now possible, as evidenced by the data presented, to formulate power transmission fluids which exhibit the high torque required for the increased performance demands of newer, smaller power transmissions while maintaining the good anti-shudder performance of lower torque power transmission fluids.

This invention is susceptible to considerable variation in its practice. Accordingly, this invention is not limited to the specific exemplifications set forth hereinabove. Rather, this invention is within the spirit and scope of the appended claims, including the equivalents thereof available as a matter of law.

The patentee does not intend to dedicate any disclosed embodiments to the public, and to the extent any disclosed modifications or alterations may not literally fall within the scope of the claims, they are considered to be part of the invention under the doctrine of equivalents.

We claim:

1. An automatic transmission fluid composition, which exhibits good anti-shudder properties, comprising (1) a major amount of a base oil and (2) a minor amount of an additive composition comprising:

(A) a dispersant having a total nitrogen to phosphorus mass ratio between about 3:1 and about 10:1; and (B) at least one friction modifier.

2. The automatic transmission fluid of claim 1 wherein the dispersant (A) is prepared by phosphorylating an ashless dispersant in an amount sufficient to yield a dispersant having a nitrogen to phosphorus mass ratio between about 3:1 and about 10:1.

3. The automatic transmission fluid of claim 1 wherein the dispersant (A) is obtained by blending (A') a phosphorylated dispersant with (A") a non-phosphorylated dispersant so as to obtain a total dispersant nitrogen to phosphorus mass ratio between about 3:1 and about 10:1.

4. The automatic transmission fluid of claim 3 wherein at least one of the dispersants, (A') or (A"), is a succinimide dispersant.

5. The automatic transmission fluid of claim 2 wherein the dispersant (A) is boronated.

6. The automatic transmission fluid of claim 3 wherein at least one of the dispersants, (A') or (A"), is boronated.

7. The automatic transmission fluid of claim 1 further comprising (C) a viscosity index improver.

8. The automatic transmission fluid of claim 7 wherein the viscosity index improver (VII) is selected from the group consisting of olefin copolymer VIIs, polyalkylmethacrylate VIIs and styrene-maleic ester isopolymer VIIs.

9. The automatic transmission fluid of claim 1 wherein the friction modifier (B) comprises a combination of (i) at least one di(hydroxyalkyl) aliphatic tertiary amine in which the hydroxyalkyl groups, being the same or different, each contain from 2 to about 4 carbon atoms, and in which the aliphatic group is an acyclic hydrocarbyl group containing from about 10 to about 25 carbon atoms, and (ii) at least one hydroxyalkyl aliphatic imidazoline in which the hydroxyalkyl group contains from 2 to about 4 carbon atoms, and in which the aliphatic group is an acyclic hydrocarbyl group containing from about 10 to about 25 carbon atoms.

10. The automatic transmission fluid of claim 1 wherein the friction modifier (B) comprises a combination of at least one N-aliphatic hydrocarbyl-substituted diethanol amine and at least one N-aliphatic hydrocarbyl-substituted trimethylene diamine in which the N-aliphatic hydrocarbyl-substituent is at least one straight chain aliphatic hydrocarbyl group free of acetylenic unsaturation and having in the range of about 14 to about 20 carbon atoms.

11. The automatic transmission fluid of claim 1 further comprising at least one additive selected from the group consisting of seal swell agents, antioxidants, corrosion inhibitors, foam inhibitors, copper corrosion inhibitors, anti-wear/extreme pressure additives, lubricity agents, and dyes.

12. A method of eliminating initial shudder in automatic transmissions, said method comprising adding to, and operating in, said automatic transmission an automatic transmission fluid as set forth in claim 1.

13. A method of obtaining anti-shudder durability in automatic transmissions, said method comprising adding to, and operating in, said automatic transmission an automatic transmission fluid as set forth in claim 1.

14. An automatic transmission fluid composition, which exhibits good anti-shudder properties, obtained by combining (1) a major amount of a base oil and (2) a minor amount of an additive composition comprising:

(A) a dispersant having a total nitrogen to phosphorus mass ratio between about 3:1 and about 10:1; and (B) at least one friction modifier.

15. The automatic transmission fluid of claim 14 wherein the dispersant (A) is prepared by phosphorylating an ashless dispersant in an amount sufficient to yield a dispersant having a nitrogen to phosphorus mass ratio between about 3:1 and about 10:1.

16. The automatic transmission fluid of claim 14 wherein the dispersant (A) is obtained by blending (A') a phosphorylated dispersant with (A") a non-phosphorylated dispersant so as to obtain a total dispersant nitrogen to phosphorus mass ratio between about 3:1 and about 10:1.

17. The automatic transmission fluid of claim 16 wherein at least one of the dispersants, (A') or (A"), is a succinimide dispersant.

18. The automatic transmission fluid of claim 15 wherein the dispersant (A) is boronated.

19. The automatic transmission fluid of claim 16 wherein at least one of the dispersants, (A') or (A"), is boronated.

20. The automatic transmission fluid of claim 14 further comprising (C) a viscosity index improver.

21. The automatic transmission fluid of claim 20 wherein the viscosity index improver is selected from the group consisting of olefin copolymer VIIs, polyalkylmethacrylate VIIs and styrene-maleic ester isopolymer VIIs.

22. The automatic transmission fluid of claim 14 wherein the friction modifier (B) comprises a combination of (i) at least one di(hydroxyalkyl) aliphatic tertiary amine in which the hydroxyalkyl groups, being the same or different, each contain from 2 to about 4 carbon atoms, and in which the aliphatic group is an acyclic hydrocarbyl group containing from about 10 to about 25 carbon atoms, and (ii) at least one hydroxyalkyl aliphatic imidazoline in which the hydroxyalkyl group contains from 2 to about 4 carbon atoms, and in which the aliphatic group is an acyclic hydrocarbyl group containing from about 10 to about 25 carbon atoms.

23. The automatic transmission fluid of claim 14 wherein the friction modifier (B) comprises a combination of at least one N-aliphatic hydrocarbyl-substituted diethanol amine and at least one N-aliphatic hydrocarbyl-substituted trimethylene diamine in which the N-aliphatic hydrocarbyl-substituent is at least one straight chain aliphatic hydrocarbyl group free of acetylenic unsaturation and having in the range of about 14 to about 20 carbon atoms.

24. The automatic transmission fluid of claim 14 further comprising at least one additive selected from the group consisting of seal swell agents, antioxidants, corrosion inhibitors, foam inhibitors, copper corrosion inhibitors, anti-wear/extreme pressure additives, lubricity agents, and dyes.

* * * * *